US009915152B2

(12) United States Patent
Koenig

(10) Patent No.: US 9,915,152 B2
(45) Date of Patent: Mar. 13, 2018

(54) TURBINE WHEEL

(71) Applicant: BorgWarner Inc., Auburn Hills, MI (US)

(72) Inventor: Igor Koenig, Frankenthal (DE)

(73) Assignee: BorgWarner Inc., Auburn Hills, MI (US)

( * ) Notice: Subject to any disclaimer, the term of this patent is extended or adjusted under 35 U.S.C. 154(b) by 261 days.

(21) Appl. No.: 14/425,660

(22) PCT Filed: Sep. 11, 2013

(86) PCT No.: PCT/US2013/059159

§ 371 (c)(1),
(2) Date: Mar. 4, 2015

(87) PCT Pub. No.: WO2014/046927

PCT Pub. Date: Mar. 27, 2014

(65) Prior Publication Data

US 2015/0211374 A1 Jul. 30, 2015

(30) Foreign Application Priority Data

Sep. 19, 2012 (DE) ..... 10 2012 018 530

(51) Int. Cl.

| | |
|---|---|
| ***F04D 29/32*** | (2006.01) |
| ***F01D 5/22*** | (2006.01) |
| ***F01D 5/04*** | (2006.01) |
| *F02B 37/00* | (2006.01) |

(52) U.S. Cl.

CPC ..... *F01D 5/225* (2013.01); *F01D 5/048* (2013.01); *F02B 37/00* (2013.01); *F05D 2220/40* (2013.01); *F05D 2250/29* (2013.01); *F05D 2260/96* (2013.01)

(58) Field of Classification Search

CPC ..... F01D 5/048

See application file for complete search history.

(56) References Cited

U.S. PATENT DOCUMENTS

| | | | | |
|---|---|---|---|---|
| 6,948,913 | B2 * | 9/2005 | Heyes | F01D 5/025 416/204 A |
| 7,189,062 | B2 * | 3/2007 | Fukizawa | F04D 25/04 416/185 |
| 8,241,005 | B2 * | 8/2012 | Emmerson | B23P 15/006 415/106 |

(Continued)

FOREIGN PATENT DOCUMENTS

| | | | |
|---|---|---|---|
| JP | 2002047944 | A | 2/2002 |
| JP | 2012149583 | A | 8/2012 |
| KR | 20110122192 | A | 11/2011 |

OTHER PUBLICATIONS

International Search Report and Written Opinion in International Application No. PCT/US2013/059159 dated Dec. 16, 2013.

*Primary Examiner* — Logan Kraft
*Assistant Examiner* — Jason Fountain
(74) *Attorney, Agent, or Firm* — Eric L. Doyle; Stephan A. Pendorf; Patent Central LLC

(57) ABSTRACT

A turbine wheel (4) having a hub (29); a multiplicity of turbine wheel blades (30) arranged around the hub (29); a turbine wheel back wall (31) which is arranged on the hub (29) adjacent to an edge region (32) of the turbine wheel blades (30); wherein the wall thickness (W) of the turbine wheel (4) back wall is reduced in regions.

5 Claims, 1 Drawing Sheet

(56) References Cited

U.S. PATENT DOCUMENTS

| | | | | |
|---|---|---|---|---|
| 8,936,439 | B2 * | 1/2015 | Duong | F01D 5/048 416/185 |
| 9,011,097 | B2 * | 4/2015 | Yokoyama | F01D 1/28 416/183 |
| 9,260,971 | B2 * | 2/2016 | Yoshida | F01D 5/048 |
| 2005/0111971 | A1 | 5/2005 | Fukizawa et al. | |
| 2011/0299987 | A1 | 12/2011 | Billotey et al. | |
| 2012/0183406 | A1 | 7/2012 | Yoshida et al. | |
| 2013/0004321 | A1 * | 1/2013 | Yokoyama | F01D 1/28 416/223 R |

* cited by examiner

TURBINE WHEEL

BACKGROUND OF THE INVENTION

Field of the Invention

The invention relates to a turbine wheel and to an exhaust-gas turbocharger.

Description of the Related Art

A known turbine wheel has a hub around which a multiplicity of turbine wheel blades are arranged. A turbine wheel back wall is arranged on the hub at an edge region, which in the installed state of the turbine wheel is adjacent to a shaft, of the turbine wheel blades.

It is an object of the present invention to provide a turbine wheel, the mass moment of inertia of which turbine wheel is reduced.

BRIEF SUMMARY OF THE INVENTION

It is accordingly possible according to invention for the wall thickness of the turbine wheel back wall to be reduced at least in regions.

The dependent claims contain advantageous developments of the inventions.

For the reduction of the wall thickness of the turbine wheel back wall in regions, said turbine wheel back wall may preferably be provided with pockets which are open on one side and which are arranged on that side of the turbine wheel back wall which faces away from the turbine wheel blades.

Said pockets are preferably arranged on the outer diameter of the turbine wheel, between the turbine wheel blades.

The depth of the pockets is dependent on the desired extent of the reduction in mass moment of inertia. In any case, however, the pockets are not formed so as to be continuous, that is to say are not formed so as to extend through the entire wall thickness of the turbine wheel back wall.

The arrangement at the outer diameter or outer circumference of the turbine wheel means that the pockets are arranged at the inlet diameter or inlet circumference of the turbine wheel.

The exhaust-gas turbocharger according to invention is provided with a turbine wheel according to the invention.

BRIEF DESCRIPTION OF THE SEVERAL VIEWS OF THE DRAWINGS

Further details, advantages and features of the present invention become apparent from the following description of exemplary embodiments with reference to the drawing, in which.

DETAILED DESCRIPTION OF THE INVENTION

Figure 1:
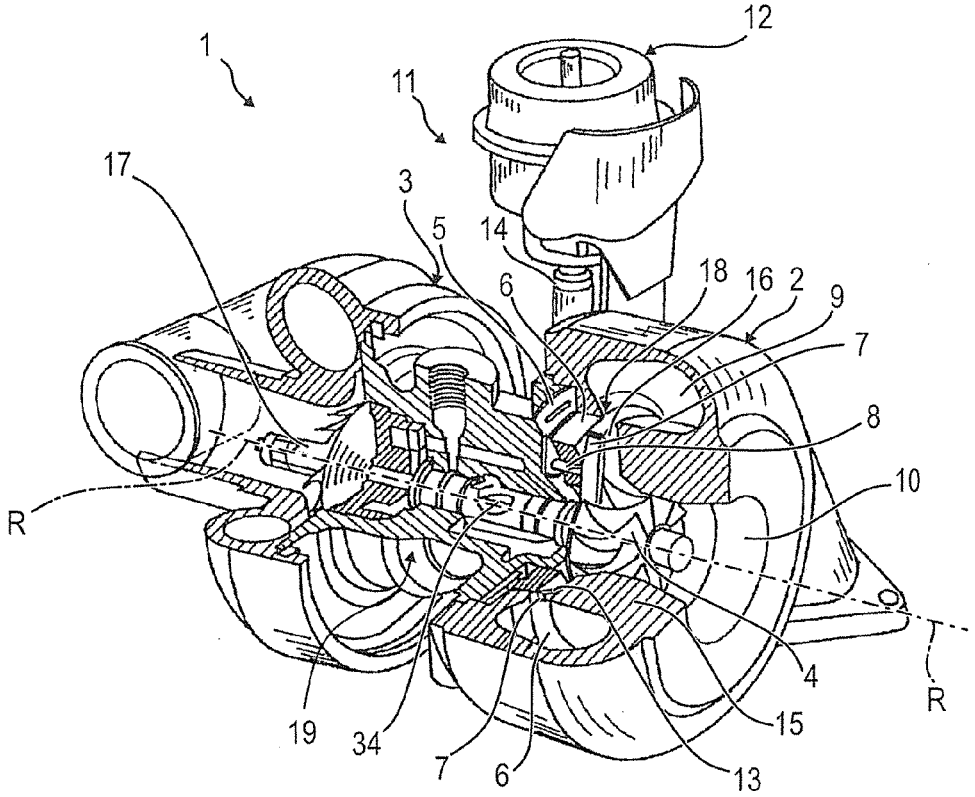
FIG. 1 shows a perspective sectional illustration through an exhaust-gas turbocharger according to the invention.

FIG. 1 illustrates an exhaust-gas turbocharger 1 according to the invention which has a turbine housing 2 in which a turbine wheel 4 is arranged.

With regard to all other components of the exhaust-gas turbocharger 1 according to the invention, reference may be made to the list of reference signs provided at the end of this description, because a detailed description of said elements is not important for explaining the principles of the present invention.

Figure 2:
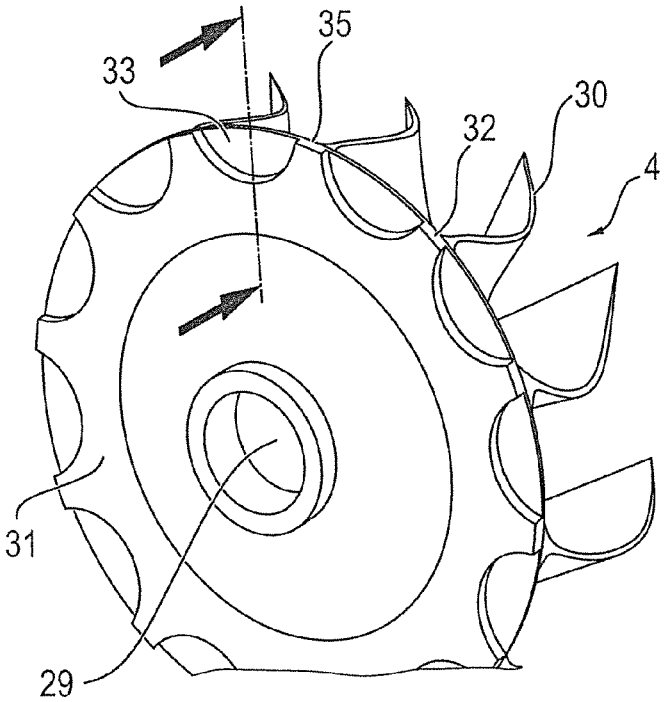
FIG. 2 shows a perspective illustration of a turbine wheel according to the invention.

The turbine wheel 4 according the invention is illustrated in FIG. 2. Said turbine wheel 4 has a hub 29 around which are arranged a multiplicity of turbine wheel blades, of which, in FIG. 2, one turbine wheel blade is identified, representatively of all of the blades, by the reference sign 30.

The turbine wheel 4 furthermore has a turbine wheel back wall 31 which is arranged on the hub 29 at an edge region 32 of the turbine wheel blades 30. As shown by FIG. 2 in conjunction with FIG. 1, the edge region 32 is that region which, in the installed state of the turbine wheel 4, faces toward a shaft 34, to which shaft the turbine wheel 4 is fastened, of the exhaust-gas turbocharger 1.

Figure 3:
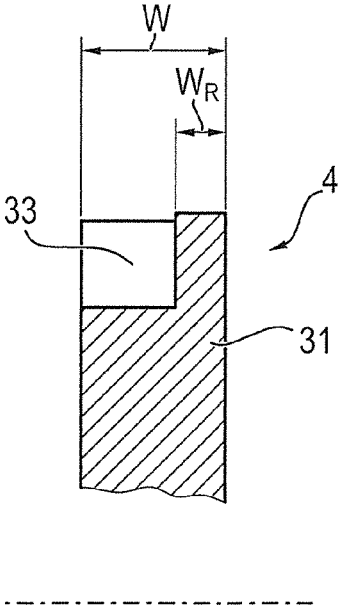
FIG. 3 shows a sectional illustration through a partial region of the turbine wheel as per FIG. 2.

As can be seen viewing FIGS. 2 and 3 together, for the reduction of the wall thickness W of the turbine wheel back wall 31 in regions, it is provided in the example that a multiplicity of pockets which are open on one side are arranged in the turbine wheel back wall 31, of which pockets one pocket 33 is denoted, representatively of all of the pockets, in FIGS. 2 and 3. The pockets 33 may be of various forms, for example semi-circular, and do not extend through the entire wall thickness W, as can be seen from the reduced wall thickness WR, indicated in FIG. 3, in the region of the pockets 33.

The pockets 33 are furthermore arranged at the outer circumference (inlet circumference) 35 of the turbine wheel 4 or of the turbine wheel back wall 31.

The number of pockets 33, and also the depth thereof in the wall thickness W of the turbine wheel back wall 31, may be reduced or increased depending on the application.

In addition to the above written disclosure of the invention, reference is hereby explicitly made to the illustrative presentation of the invention in FIGS. 1 to 3.

LIST OF REFERENCE SIGNS

1 Turbocharger
2 Turbine housing
3 Compressor housing
4 Turbine wheel
5 Unison ring
6 Blade bearing ring
7 Adjusting blades
8 Rotary axles
9 Supply duct
10 Axial connector
11 Actuating device
12 Control casing
13 Free space for adjusting blades 7
14 Plunger element
15 Annular part of the turbine housing 2
16 Spacer/spacer cam
17 Compressor wheel
18 Guide grate
28 Bearing housing
29 Hub
30 Turbine wheel blades
31 Turbine wheel back wall
32 Edge
33 Pockets
34 Shaft
W Wall thickness of the turbine wheel back wall $W_R$ Reduced wall thickness
R Axis of rotation

The invention claimed is:

1. A turbine wheel (4) having a hub (29) including a radially enlarged disc-like portion of the hub, the disc-like portion defining a floor on one side and a backwall (31) on the other side and a radially outer edge, with a wall defined between the floor and the backwall (31); and a multiplicity of turbine wheel blades (30) arranged around the hub (29);

wherein the radially outer edge has regions with a first wall thickness (W) and regions with a reduced wall thickness compared to the first wall thickness (W) of the radially enlarged disc-like portion of the hub, the turbine wheel back wall (31) regions of reduced thickness are defined by pockets (33) which are open radially outwardly, and the pockets (33) do not extend through the entire wall thickness (W) of the turbine wheel backwall (31).

2. The turbine wheel as claimed in claim 1, wherein the pockets (33) are arranged on the outer edge region of the turbine wheel backwall (31) between blades.

3. An exhaust-gas turbocharger (1) having a turbine housing (2) in which is arranged a turbine wheel (4) which has:

a hub (29) including a radially enlarged disc-like portion of the hub, the disc-like portion defining a floor on one side and a backwall (31) on the other side and a radially outer edge, with a wall defined between the floor and the backwall (31); and a multiplicity of turbine wheel blades (30) arranged around the hub (29);

wherein the radially outer edge has regions with a first wall thickness (W) and regions with a reduced wall thickness compared to the first wall thickness (W) of the radially enlarged disc-like portion of the hub, and the pockets (33) do not extend through the entire wall thickness (W) of the turbine wheel backwall (31).

4. The exhaust-gas turbocharger as claimed in claim 3, wherein the turbine wheel back wall (31) has at least one pocket (33) which is open radially outwardly.

5. The exhaust-gas turbocharger as claimed in claim 3, wherein the pockets (33) are arranged on the radially outer edge of the turbine wheel backwall (31).

* * * * *